US006821057B1

(12) United States Patent
Kadiu

(10) Patent No.: US 6,821,057 B1
(45) Date of Patent: Nov. 23, 2004

(54) MAGNETIC SHORING DEVICE

(76) Inventor: Maksim Kadiu, Cupertino Post Office, Cupertino, CA (US) 95014-9998

( * ) Notice: Subject to any disclaimer, the term of this patent is extended or adjusted under 35 U.S.C. 154(b) by 0 days.

(21) Appl. No.: 09/543,442

(22) Filed: Apr. 5, 2000

(51) Int. Cl.[7] ..... E02D 5/00

(52) U.S. Cl. ..... 405/282; 405/272

(58) Field of Search ..... 405/272, 273, 405/276, 278, 279, 282, 295; 403/DIG. 1; 248/206.5, 309.4

(56) References Cited

U.S. PATENT DOCUMENTS

| | | | | | |
|---|---|---|---|---|---|
| 1,634,104 | A | * | 6/1927 | Herrick et al. | 405/282 |
| 1,794,704 | A | | 3/1931 | Miller | |
| 1,847,842 | A | | 3/1932 | Cauley, Jr. et al. | |
| 1,877,351 | A | | 9/1932 | Meem | |
| 1,895,985 | A | | 1/1933 | Goldsborough | |
| 1,909,980 | A | | 5/1933 | Newman | |
| 2,188,077 | A | | 1/1940 | Dowd | |
| 2,350,113 | A | | 5/1944 | Hurley | |
| 2,482,367 | A | | 9/1949 | Ravers, Jr. | |
| 2,584,015 | A | | 1/1952 | Hawes | |
| 2,659,210 | A | | 11/1953 | Stengel et al. | |
| 2,796,738 | A | | 6/1957 | Moore | |
| 2,956,409 | A | * | 10/1960 | Wicke | 405/282 |
| 2,994,974 | A | | 8/1961 | Domenighetti | |
| 3,047,931 | A | * | 8/1962 | Boettner | 249/18 |
| 3,159,977 | A | | 12/1964 | De Lillo | |
| 3,159,978 | A | | 12/1964 | De Lillo | |
| 3,186,177 | A | * | 6/1965 | Kannenberg | 405/282 |
| 3,212,270 | A | * | 10/1965 | Benintend | 405/272 |
| 3,224,201 | A | | 12/1965 | Brunton | |
| 3,230,720 | A | | 1/1966 | Bennett | |
| 3,263,430 | A | * | 8/1966 | Bryan | 405/282 |
| 3,295,330 | A | | 1/1967 | Meshorer | |
| 3,331,210 | A | | 7/1967 | Wenninger | |
| 3,335,573 | A | | 8/1967 | Ward | |
| 3,347,049 | A | | 10/1967 | Faltersack et al. | |
| 3,362,167 | A | | 1/1968 | Ward | |

(List continued on next page.)

FOREIGN PATENT DOCUMENTS

| | | |
|---|---|---|
| EP | 0 039 960 | 11/1981 |
| EP | 0 046 553 | 3/1982 |
| EP | 0 100 083 | 2/1984 |
| EP | 0 144 007 | 6/1985 |
| EP | 0 628 663 | 12/1994 |
| EP | 0 712 962 | 5/1996 |
| EP | 0 810 328 | 12/1997 |
| EP | 0 921 235 | 6/1999 |
| EP | 1 193 350 | 4/2002 |
| GB | 1 454 022 | 10/1976 |
| WO | WO 84/00572 | 2/1984 |

*Primary Examiner*—Gary S. Hartmann
(74) *Attorney, Agent, or Firm*—Morrison & Foerster LLP

(57) ABSTRACT

This apparatus relates to shoring of deep excavations such as pits or trenches. It includes vertical rail posts arranged symmetrically in pairs which are spaced form each other along the excavation, articulated trusses holding opposite rail posts against each other and large shoring panels sliding between adjacent rail posts on either side of the excavation. Each rail post has on either side one channel of stepped cross section guiding vertically two or more shoring panels. The connections between the post and the panel are partially or completely open. The open connections are performed by magnetic forces engendered by thin magnetic flat bars incorporated in the posts or the panels in the area of their contact. The articulated truss is of scissoring type composed of triangular cells only and their members have pinned connections. The cross members of the truss are pinned together in their mi-length enabling their relative rotation while their extremities are pinned into the vertical members which have several row of pinning holes in order to adjust the width of the trench without need for additional spreaders. The vertical members of the truss slide formlockingly between pair of opposite posts and could be adjusted at any level form the bottom of excavation.

11 Claims, 15 Drawing Sheets

U.S. PATENT DOCUMENTS 3,379,018 A 4/1968 Frentzel et al.
3,393,521 A 7/1968 Cammisa
3,404,533 A 10/1968 Brunton
3,470,699 A 10/1969 Cox
3,530,679 A 9/1970 Krings
3,584,465 A 6/1971 Holl
3,593,528 A 7/1971 Pavese
3,621,660 A 11/1971 Krings
3,668,874 A 6/1972 Krings
3,710,578 A 1/1973 Inoue
3,727,413 A 4/1973 Christen
3,729,938 A 5/1973 Morrice
3,766,740 A 10/1973 Teegen
3,782,125 A 1/1974 Holl
3,782,126 A 1/1974 Pavese
3,788,086 A * 1/1974 West, Jr. ..... 405/283
3,791,151 A 2/1974 Plank
3,831,384 A 8/1974 Kempster
3,851,856 A 12/1974 Berg
3,858,399 A 1/1975 Krings
3,864,921 A 2/1975 Marx et al.
3,869,867 A 3/1975 Krings
3,881,679 A 5/1975 Krings
3,910,053 A * 10/1975 Krings ..... 405/282
3,910,054 A 10/1975 Krings
3,937,026 A 2/1976 Krings
3,950,952 A 4/1976 Krings
3,967,454 A 7/1976 Barnes
3,969,852 A 7/1976 Krings
3,995,565 A 12/1976 Kersey
3,999,393 A 12/1976 Krings
4,019,328 A 4/1977 Koehl
4,048,778 A 9/1977 Krings
4,054,033 A 10/1977 Pillosio
4,056,940 A 11/1977 Fisher
4,059,964 A 11/1977 Pavese
4,090,365 A 5/1978 Nieber
4,099,386 A 7/1978 Sagasta
4,114,383 A 9/1978 Nieber
4,139,324 A 2/1979 Krings
4,145,891 A 3/1979 Krings
4,154,062 A 5/1979 Koehl
4,159,585 A 7/1979 Brown
4,168,053 A 9/1979 Boenninghaus
4,188,159 A 2/1980 Clarke et al.
4,199,278 A 4/1980 Koehl
4,202,649 A 5/1980 Cook et al.
4,247,997 A 2/1981 Paurat et al.
4,259,028 A 3/1981 Cook
4,259,029 A 3/1981 Koehl
4,259,030 A 3/1981 Montoya
4,274,763 A * 6/1981 Krings ..... 405/282
4,279,548 A 7/1981 Ramey
4,310,267 A 1/1982 Davis
4,345,857 A 8/1982 Krings
4,370,079 A 1/1983 Pizzirani
4,372,709 A 2/1983 Krings
4,376,599 A 3/1983 Krings
4,421,440 A 12/1983 Scheepers
4,453,861 A 6/1984 Bretz et al.
4,453,863 A * 6/1984 Sutton et al. ..... 405/282
4,472,090 A 9/1984 Krings
4,484,842 A 11/1984 Engelhaupt
4,487,530 A 12/1984 Morrice
4,501,517 A 2/1985 Seyle
4,521,137 A 6/1985 Brecht
4,547,097 A 10/1985 Bell
4,548,528 A 10/1985 Bell
4,591,298 A 5/1986 Fukumori et al.
4,657,442 A 4/1987 Krings
4,659,261 A 4/1987 Chiaves
4,682,914 A 7/1987 Aihara et al.
4,685,837 A 8/1987 Cicanese
4,695,204 A 9/1987 Bell
4,696,607 A 9/1987 Ressi di Cervia
4,752,157 A 6/1988 Ischebeck et al.
4,787,781 A 11/1988 Bradberry
4,843,780 A 7/1989 Krings
4,874,271 A 10/1989 Arnold
4,886,399 A 12/1989 Pidgeon
4,900,197 A 2/1990 Ward
4,960,258 A * 10/1990 Stocker et al. ..... 248/467
4,993,877 A 2/1991 Beamer
4,993,878 A 2/1991 Beamer
4,993,880 A 2/1991 Collins
5,000,621 A 3/1991 Beamer
5,011,331 A 4/1991 Clavarino
5,044,831 A 9/1991 Myles et al.
5,052,862 A 10/1991 Uffmann
5,073,066 A 12/1991 Richland
5,080,533 A * 1/1992 Cooper ..... 405/282
5,096,334 A 3/1992 Plank
5,123,785 A 6/1992 Orfei
5,129,763 A 7/1992 Deusenbery
5,154,541 A 10/1992 Boren et al.
5,158,398 A 10/1992 Pinho
5,167,468 A 12/1992 Crafton
5,174,685 A 12/1992 Buchanan
5,180,256 A 1/1993 Krings
5,183,316 A 2/1993 Ottestad
5,188,332 A * 2/1993 Callas ..... 248/544
5,190,412 A 3/1993 Salvatore
5,195,849 A 3/1993 Stapleton
5,197,829 A 3/1993 Krings
5,199,824 A 4/1993 Smith et al.
5,209,606 A 5/1993 Plank
5,232,312 A 8/1993 Jennings et al.
5,232,313 A * 8/1993 Jennings et al. ..... 405/283
5,259,705 A 11/1993 Breaux et al.
5,277,522 A 1/1994 Pertz
5,281,051 A 1/1994 Stegall
5,290,129 A 3/1994 Rody et al.
5,302,054 A 4/1994 Winkler et al.
5,305,568 A 4/1994 Beckerman
5,306,103 A 4/1994 Spencer
5,310,289 A * 5/1994 Hess ..... 405/282
5,310,290 A 5/1994 Spencer
5,320,440 A 6/1994 Papadopoulos
5,336,023 A 8/1994 Burdine
5,344,258 A 9/1994 Papadopoulos
5,348,421 A 9/1994 Stegall
5,393,171 A 2/1995 Stegall
5,399,057 A 3/1995 Cunic
5,401,122 A 3/1995 Pate, Jr.
5,499,890 A 3/1996 Kishi
5,503,504 A * 4/1996 Hess et al. ..... 405/282
5,513,555 A 5/1996 Plank et al.
5,516,238 A 5/1996 Beury
5,522,678 A 6/1996 Marshall et al.
5,527,137 A 6/1996 Spencer
5,533,838 A 7/1996 Kundel
5,595,459 A 1/1997 LoMonaco
5,611,643 A 3/1997 Tallard
5,624,206 A 4/1997 Cohen et al.
5,669,738 A 9/1997 Kundel
5,720,580 A 2/1998 Ryhsen
5,725,330 A 3/1998 Krings
5,735,642 A 4/1998 Barringer
5,741,091 A 4/1998 St. George et al.
5,829,921 A 11/1998 Krings
5,839,707 A 11/1998 Barringer 5,865,567 A 2/1999 Wilkinson
5,868,060 A 2/1999 Plank et al.
5,868,526 A 2/1999 Caulder
5,876,153 A 3/1999 Krings
5,885,033 A 3/1999 Krings
5,902,075 A 5/1999 Krings
5,931,607 A 8/1999 Hess
5,931,608 A 8/1999 Wilkinson
6,017,170 A 1/2000 Michalo
6,039,522 A 3/2000 Cardona
6,155,750 A 12/2000 Wu et al.
6,164,874 A 12/2000 May
6,164,875 A 12/2000 Wu et al.
6,224,296 B1 * 5/2001 Fukumori ..... 405/282
6,267,538 B1 7/2001 Caldwell
6,416,259 B1 7/2002 Meyer
6,443,665 B1 9/2002 Kundel, Sr.
6,474,911 B1 11/2002 Krings

* cited by examiner

VIEW I-I

VIEW I-I

VIEW 2-2

MAGNETIC SHORING DEVICE

TECHNICAL FIELD

This invention relates to shoring apparatuses or devices for trenches, pits or other types of open excavations employed in construction industry.

BACKGROUND OF THE INVENTION

This invention relates to shoring devices for open excavations such as trenches and pits. The device includes vertical rail posts spaced apart from each other along the trench and arranged symmetrically on both sides of the trench. Opposite rail posts are kept vertically equidistant on either side of the trench by an articulated truss able to adjust the trench width. The rail post has on both sides a channel of stepped cross section. Each step constitutes a vertical guide to slide at least one shoring panel. The shoring panels slide between each corresponding guide of adjacent rail posts and, according to the number of the guides, form two or more shoring walls. Thus, the panels slide past each other creating stepped shoring wall from the top to the bottom of the excavation. The outermost and innermost steps of the shoring wall are called respectively "outer" and "inner walls" and so the panels. All other panels in between are called "intermediate". The connections between rail posts and shoring panels are performed by magnetic forces engendered by magnetic flat bar incorporated in the lateral ends of the panels. For safety purposes partial locking may be used for the outer and inner panels. The intermediate panels slide completely free relative to the rail post. The articulated truss is of scissoring type composed by triangular cells only. The cross members of the truss are pinned at their midlength allowing rotation relative to each other such rotation allows adjustment of the truss width to several trench widths. The extremities of the cross members are pinned into vertical members of the truss which slide "formlockingly" along the rail post. For very deep applications, the vertical members of the truss have lateral guides for sliding additional panels at the bottom of excavation.

It is known to provide shoring devices having vertical rail posts, shoring panels and horizontal spreaders pressing the shoring walls against side wall of the trench. Such shoring devices are called as 'Slide Rail Shoring Systems'.

Previous slide rail shoring systems as disclosed in U.S. Pat. Nos. 3,910,053 and 4,657,442 (Krings), use a rail post having individual formlocking channel connections of 'C' type for sliding the panels. The load developed by the active pressure of the excavation walls is spread on very limited areas of contact between post and panel whereon the stresses are highly concentrated becoming sources of high friction and temperature during the installation and removal of the system. Thus, damages is caused to both rail post and the panel, which strongly limit the application of a such system in pipeline productions, where the installation and removal of the system are effectuated continuously.

The U.S. Pat. Nos. 5,310,289 and 5,503,504 (Hess et al.), disclose a rail post having a unique channel for a maximum of two shoring walls, created by an outer and by an inner panel. Only the outer panel slides formlockingly within the post; the inner panel is completely free and slides inside the outer panel and the rail posts. The design of inner panel presents a risk of kicking in the trench when adjacent rail posts are not plumb. This is an important safety concern for the worker inside the trench. This phenomenon becomes prominent when the depth of excavation is over 20' deep. On the other hand, shoring of excavations over 16' deep requires the stacking and connection of two or more panels, which later must be removed at once. Removing two or more panels at once is a very difficult task and sometimes even impossible to accomplish even when heavy duty equipment is used. Yet another concern faced by this design is the difficulty of removing the inner panel when the deflection of the upper panel has begun. Also, it should be noted that a slide rail shoring system using differing types of panels a requires much bigger inventory of panels than its counterparts that use interchangeable panels.

The U.S. Pat. Nos. 3,950,952 (Krings), 5,310,289 and 5,503,504 (Hess et al) disclose very similar strut frames having a rectangular structure where the vertical members are equipped with rollers. These frames are designed to slide vertically between opposite rail posts in order to support the load coming from either side of the shoring walls. From an engineering standpoint, a frame having a rectangular cell is not a stable structure because it will deform without affecting the length of its members. Additionally, the lower horizontal strut of the frame diminishes the pipe culvert thereby requiring special solutions for the installation of pipes having big diameters or of big box culverts.

BRIEF SUMMARY OF THE INVENTION

Substantially, the intent of present invention is to provide a shoring device of the type described above that reduce the friction and the stresses in the contacts between components, while increases the safety and eases its use in great depths. Pursuing this object and others that will become explicit hereafter, one aspect of the present invention resides on the design of the rail post. The rail post has channels of stepped cross section that permit the presence of more than two shoring walls in that single channel without increasing the material expenditure and eliminate the interference between panels as well. Since the vertical guide of the rail post is of stepped cross section, it excludes the contact between rail post and back panel, while the contact area in the front panel is increased. Another new aspect of the invention is the incorporation of magnetic flat bars in the lateral ends of the panels thereby simplifying the connections between rail post and panels and reducing the risk of damage.

The first object of this invention is to present a slide rail system having partially or completely open sliding connections for the panels along the rail post. Also, it is an object of this invention to provide a rail post in which two or more panels may slide past each other, without need for stacking. This tremendously extends the shoring depth for a slide rail shoring system. Another object of this invention is to present an articulated truss able to adjust to several trench widths, while providing a big pipe culvert. The truss is able to preform a role in addition to just supporting opposing rail posts, such sliding additional panels in its vertical members. Also, it is the object of the invention to introduce accessory devices to be used in conjunction with the slide rail shoring system to increase safety and to facilitate its installation and removal. It is the final object of this invention to present a slide rail shoring system that has no practical limit to the depth of excavation.

The new features of the invention are set forth in the appended claims. Other advantages of the invention will be appreciated upon review of the following description and drawings.

BRIEF DESCRIPTION OF THE SEVERAL VIEWS OF THE DRAWINGS

FIG. 1 is a sectional view of a trench showing two rail posts and an articulated truss in between.

DETAILED DESCRIPTION OF THE INVENTION

Figure 1:
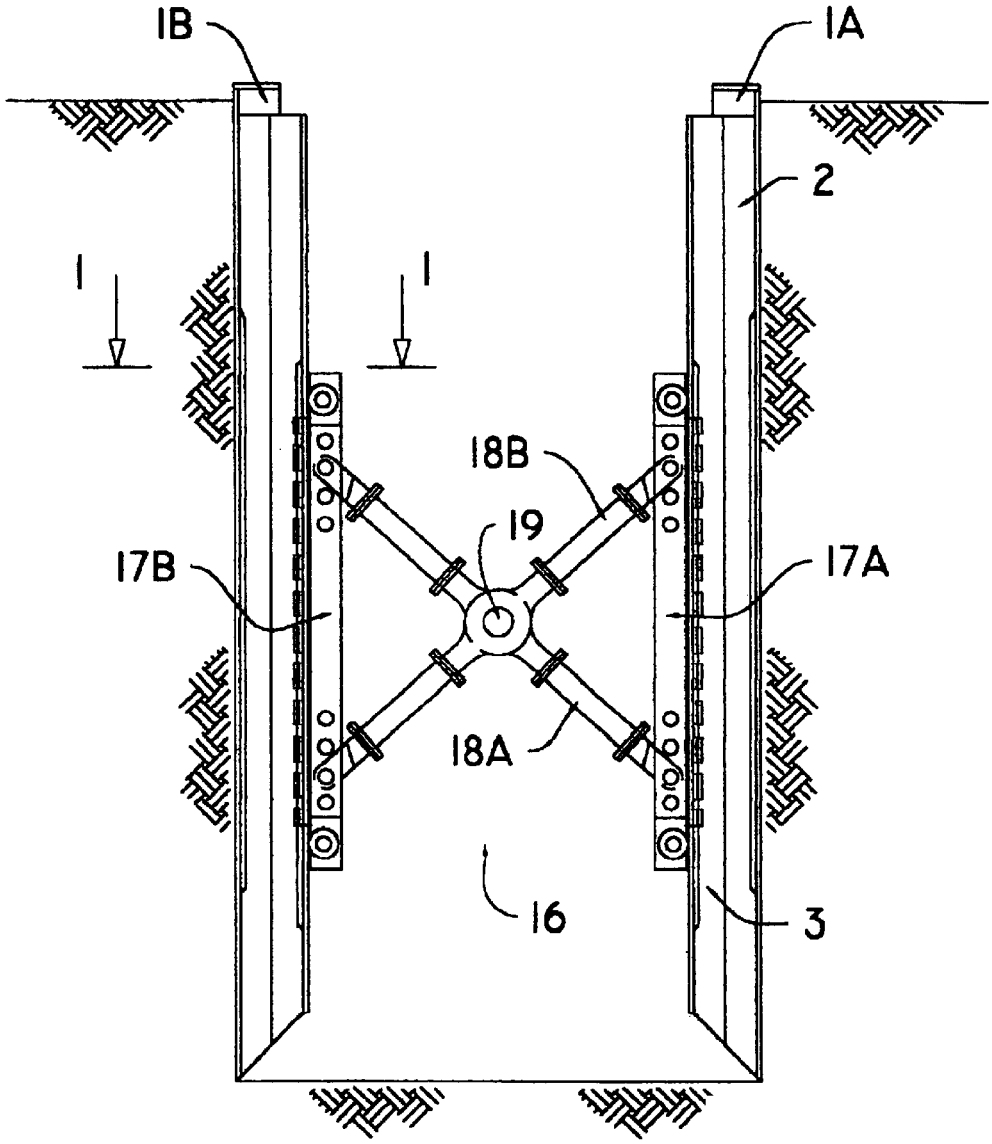
Figure 2:
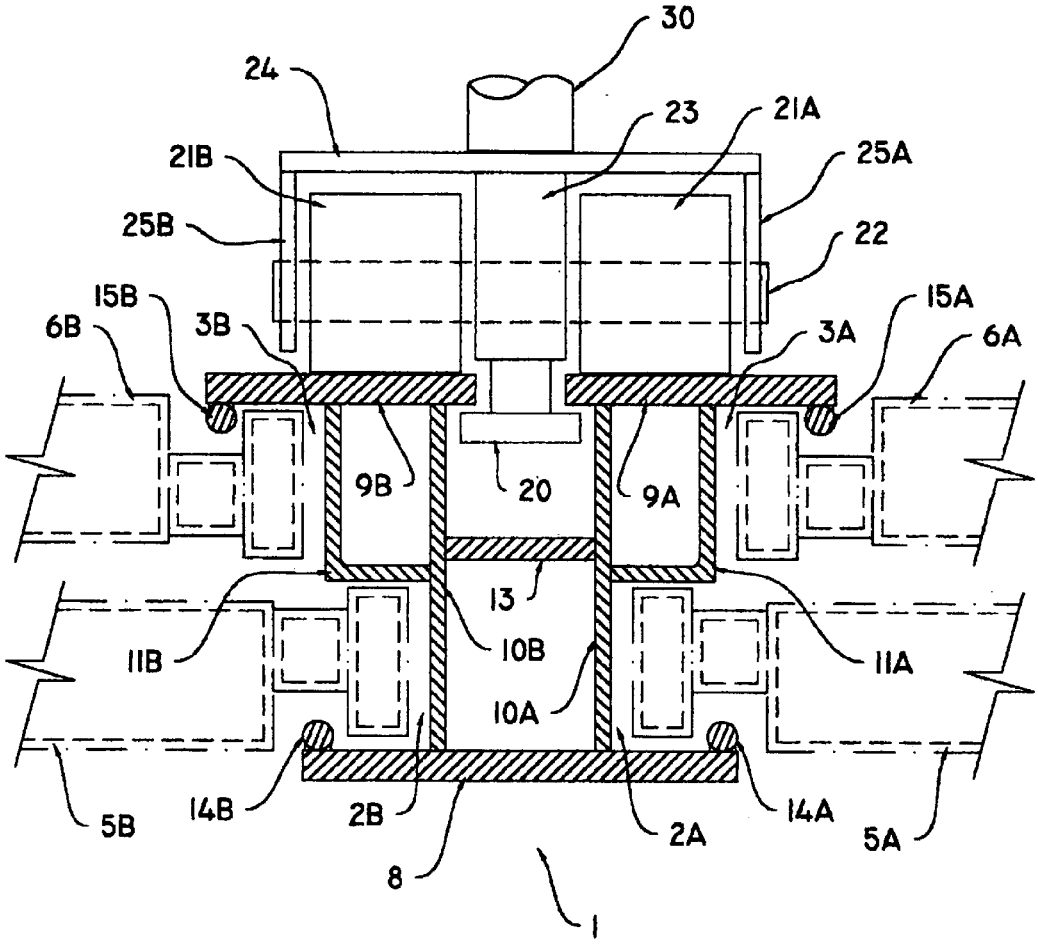
FIG. 2 is a sectional view taken along the line I—I of the FIG. 1, showing a cross section of the rail post, shoring panels laterally on either side, and the top view of the vertical member of the articulated truss.
Figure 3:
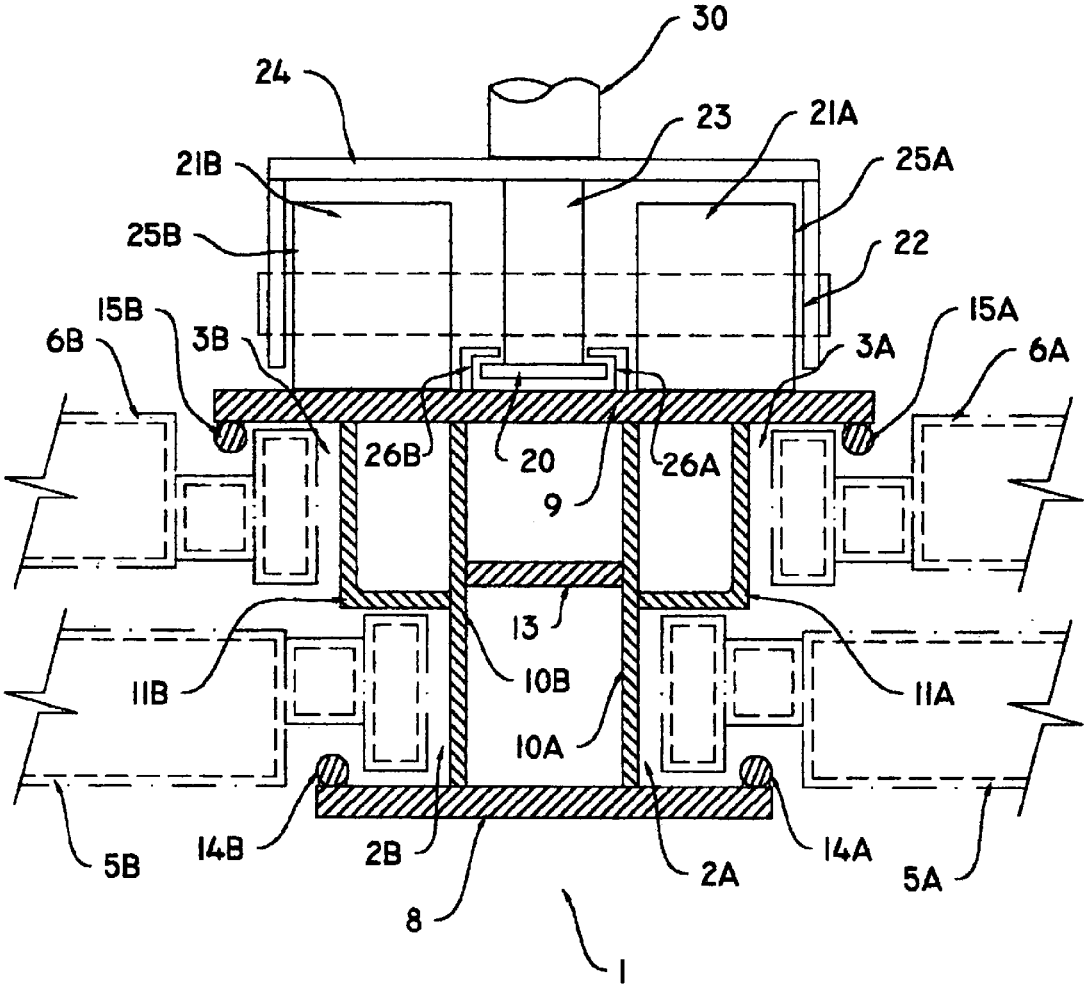
FIG. 3 is a schematic, top, fragmentary, sectional view of a linear rail post depicting another connection with the articulated truss.
Figure 4:
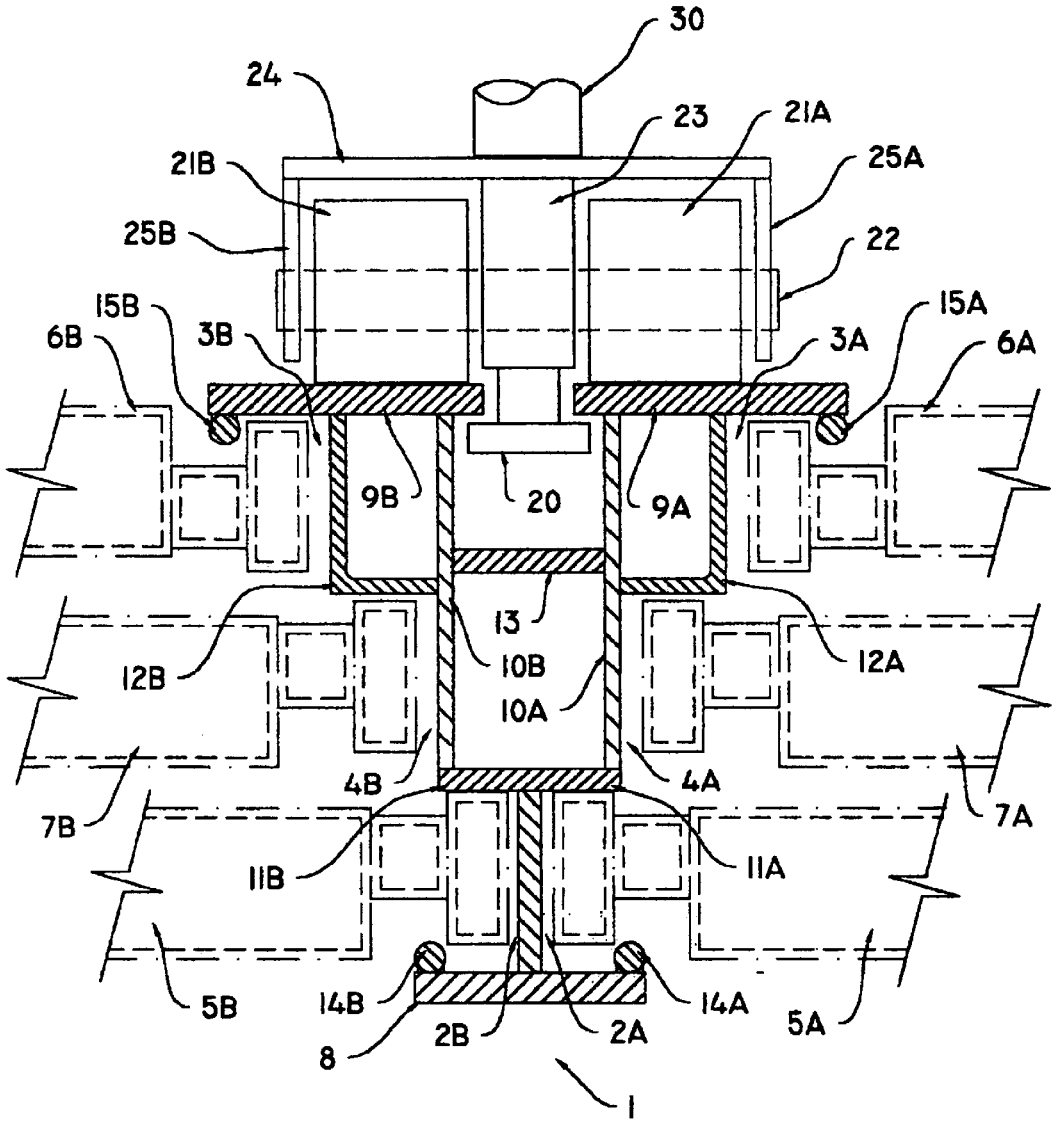
FIG. 4 is a schematic, top, fragmentary, sectional view of a linear rail post as shown in FIG. 1, but with three guides for the panels.

Referring to the drawings where like numerals indicate like elements, various embodiments incorporating the new features of the present invention are illustrated. The shoring device has two or more pairs of rail posts spaced from each other along the excavation. FIG. 1 illustrates a pair of linear rail posts 1A and 1B, located symmetrically on either side of the trench. Each rail post has laterally on either side at least two guides 2 and 3 for sliding large shoring panels between adjacent rail posts. The opposite rail posts 1A and 1B are kept vertically equidistant by an articulated truss 16, which is composed of cross members 18A and 18B, pinned together at their midlength with the axle pin 19, and by the vertical members 17A and 17B. As shown in FIG. 2, the panel guides 2A and 3A are inside a unique channel of stepped cross section shaped by the pieces 8, 9A, 10A, and the angle 11A. The round bars 14A and 15A partially lock the shoring panels 5A and 6A, and round bars at back? 15B partially lock shoring panels 5B and 6B, which shape thereby respectively an outer and an inner shoring wall. The front side of the rail post 1, as viewed looking into the excavation, has a 'C' channel shaped by the pieces 9A, 9B, 10A, 10B and 13, wherein one vertical member of the articulated truss slides and is horizontally locked by the T shaped piece 20. The load originating from the excavation wall is transmitted from the panels to the articulated truss through the rail post and the rollers 21A and 21B which are supported by the axles 22, axle holder 23, and located at the extremities of the vertical member 17 of the truss. As shown in the FIG. 3, the channel for sliding connection between the articulated truss and the rail post could be exterior to the rail post and made by two angle pieces 26A and 26B. As shown in the FIG. 4, the rail post could have laterally intermediate panel guides 4A and 4B shaped respectively by the angle pieces 12A and 12B. Therefore, an intermediate shoring wall may be formed by the shoring panels 7A and 7B.

Figure 5:
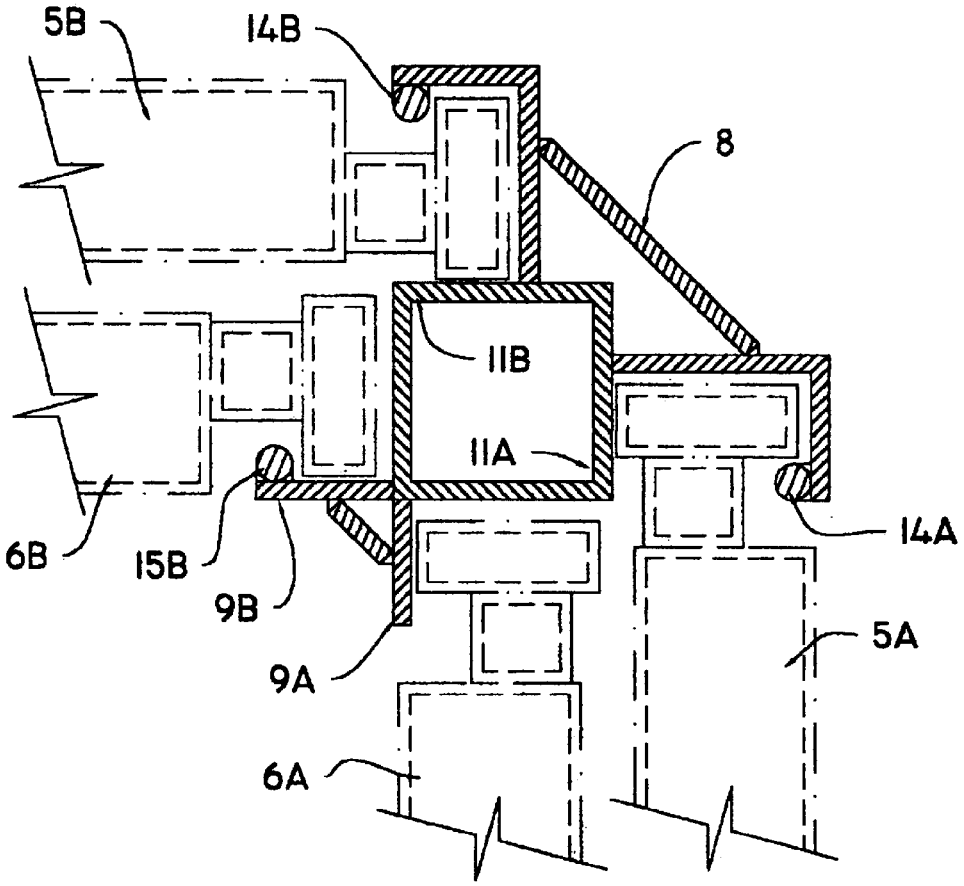
FIG. 5 shows a schematic, top, fragmentary, sectional view of a corner rail post, having guide channels oriented perpendicularly to each other for creating perpendicular shoring walls.

FIG. 5 shows a top fragmentary sectional view of a rail post, a corner rail post," for pit applications. Steps 11A and 11B are situated within perpendicular planes and allow panels 5A and 5B to slid and shape adjacent outer shoring walls. Likewise, the steps made by the pieces 9A and 9B hold the panels 6A and 6B of the inner shoring walls.

In a corner rail post, round bar 15 (A or B) is optional because the inner panels 6A and 6B block each other due to the load coming from perpendicular directions and the fact that the inner panel are installed after the outer one.

Figure 6:
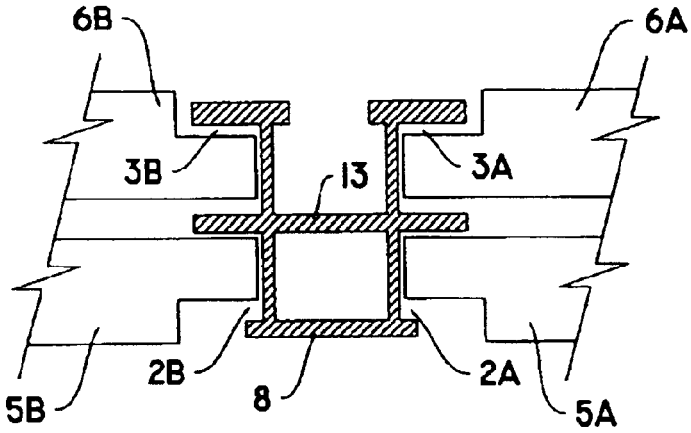
FIG. 6 is a schematic, top, fragmentary, sectional view of a linear rail post as shown in FIG. 1, but depicting guide channels which are completely open for sliding the panels.

As shown in FIG. 6, channels 2A, 3A and 2B, 3B are used for guiding respectively panels 5A, 6A and 5B, 6B in the linear rail post, and may be completely open when using magnetic connections. The panels have the same length and mirror each other relative to piece 13.

Figure 7:
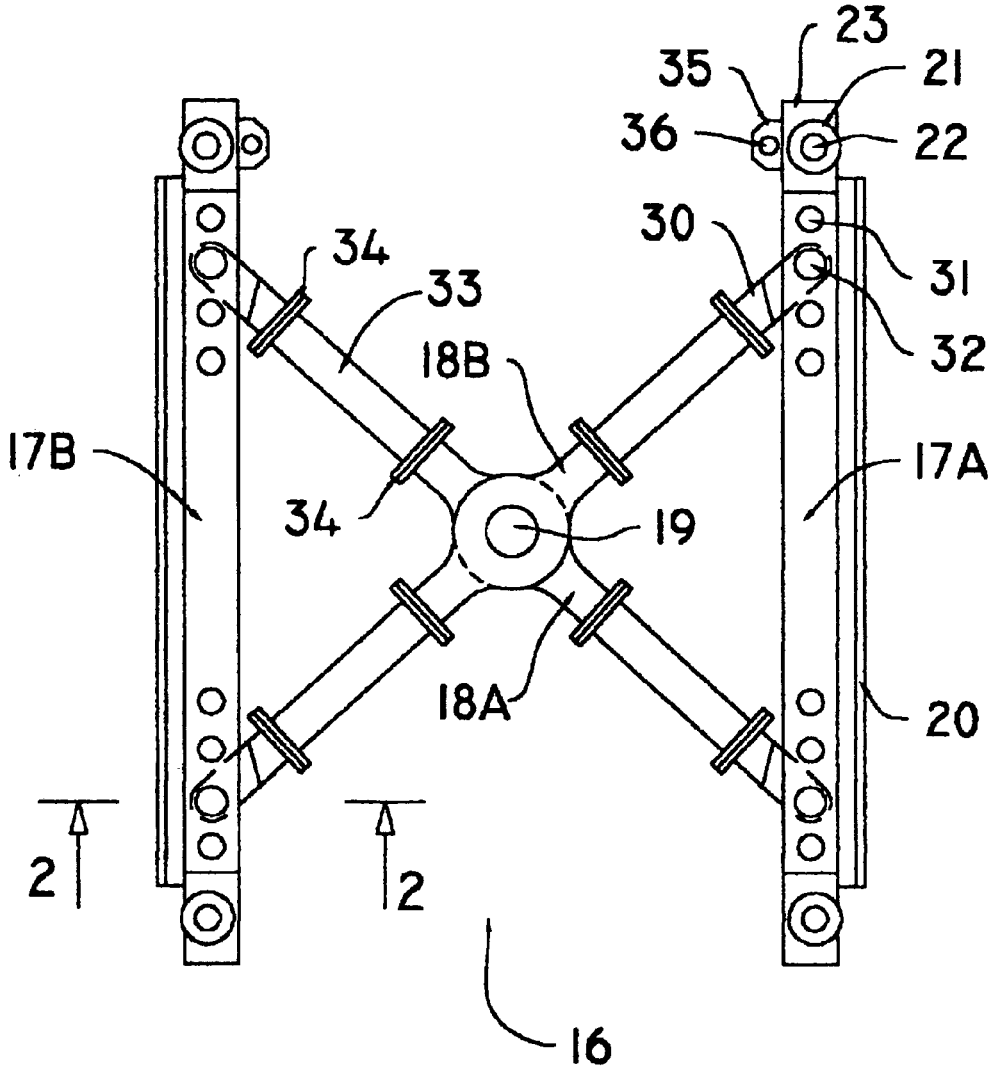
FIG. 7 shows a side view of the articulated truss similar to that shown in the FIG. 1.
Figure 8:
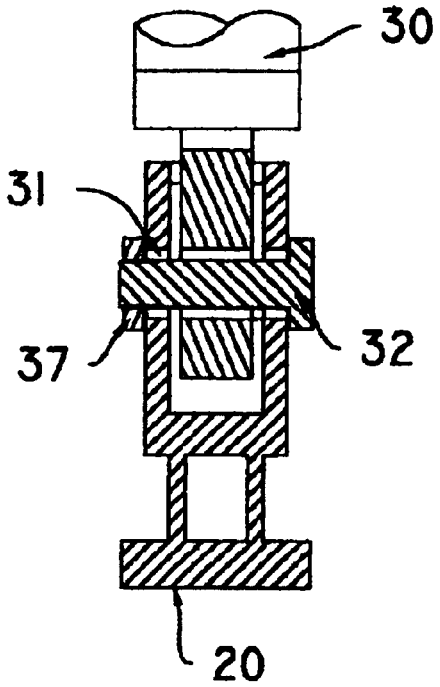
FIG. 8 is a sectional view taken along the line 2—2 of FIG. 7, showing the pin connections between cross and vertical members of the truss.
Figure 9:
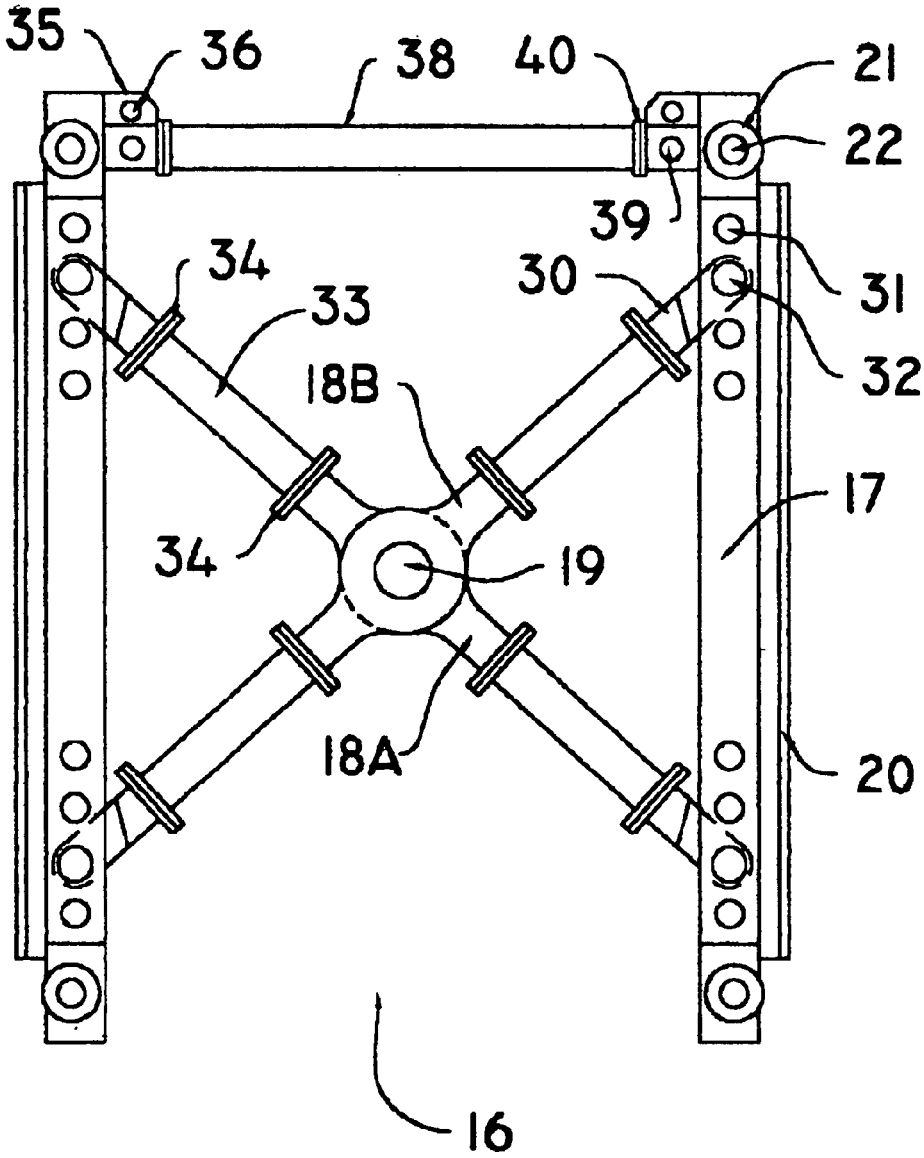
FIG. 9 shows a side view of the articulated truss having a horizontal strut connecting the upper part of the vertical members.
Figure 10:
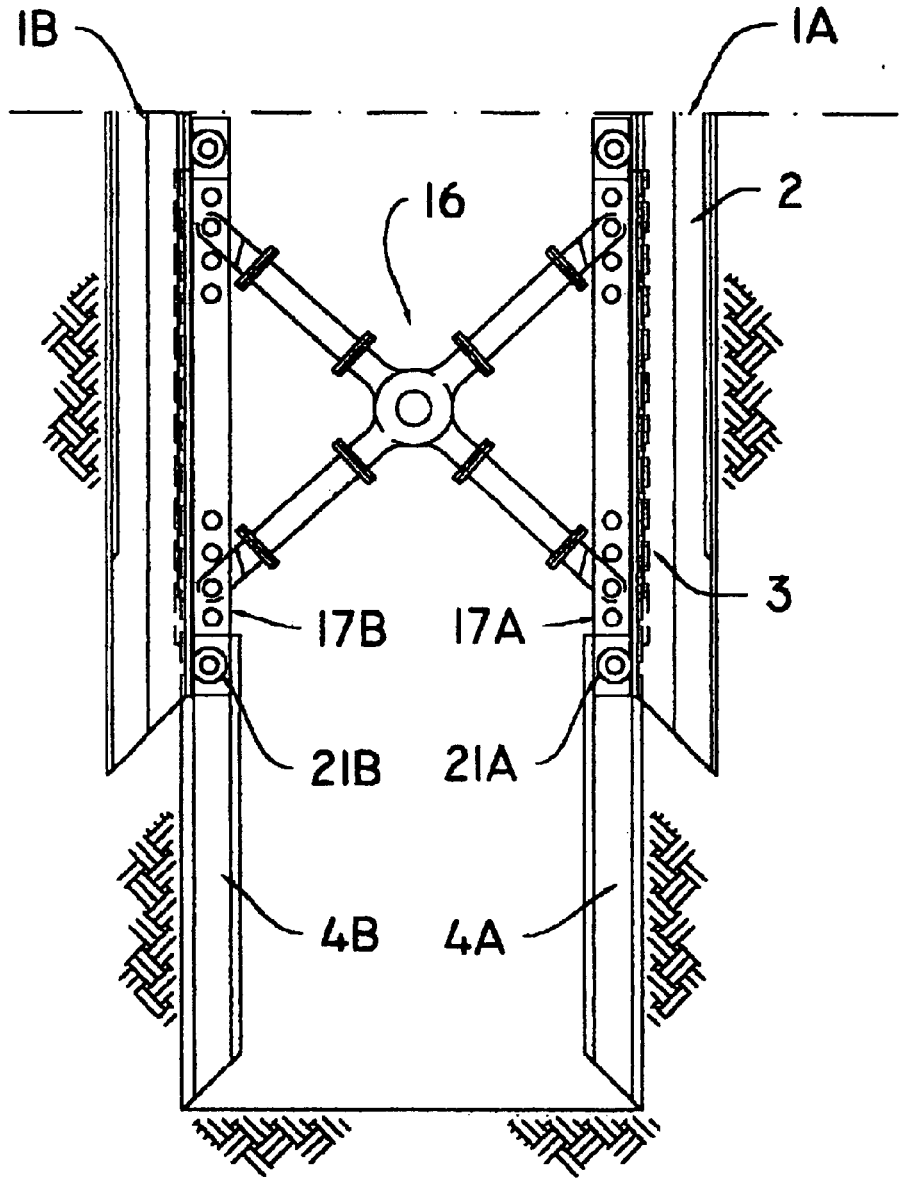
FIG. 10 shows a side view of an articulated truss wherein the vertical members have, on either side, guide channels for sliding additional panels.

As shown in FIG. 7, the articulated truss 16 has only triangular cells. The cross members 18A and 18B are connected to the vertical members 17A and 17B via the extension 33, flanges 34 and pin connector 30. The pin connector 30 is fixed in one of holes 31 by pin 32. For the same length of extensions 33, the width of the truss (and there for the width of), could be easily modified by moving the pin connector from one hole 31 to another one. The articulated truss is manipulated by lifting holes 36 of edges 35. As shown in FIG. 8, a nut 37 secures pin 32 of the connector 30. FIG. 9 shows a horizontal strut 38 used within articulated truss 16. The strut 38 is connected to the vertical members of the truss via contact flanges 40 and pin 39. Yet another type of articulated truss 16 is shown in FIG. 10, where vertical members 17A and 17B are extended way below the rollers 21A and 21B (collectively 21 in FIGS. 7 and 9) creating guides 4A and 4B for sliding additional panels in very deep excavations.

Figure 11:
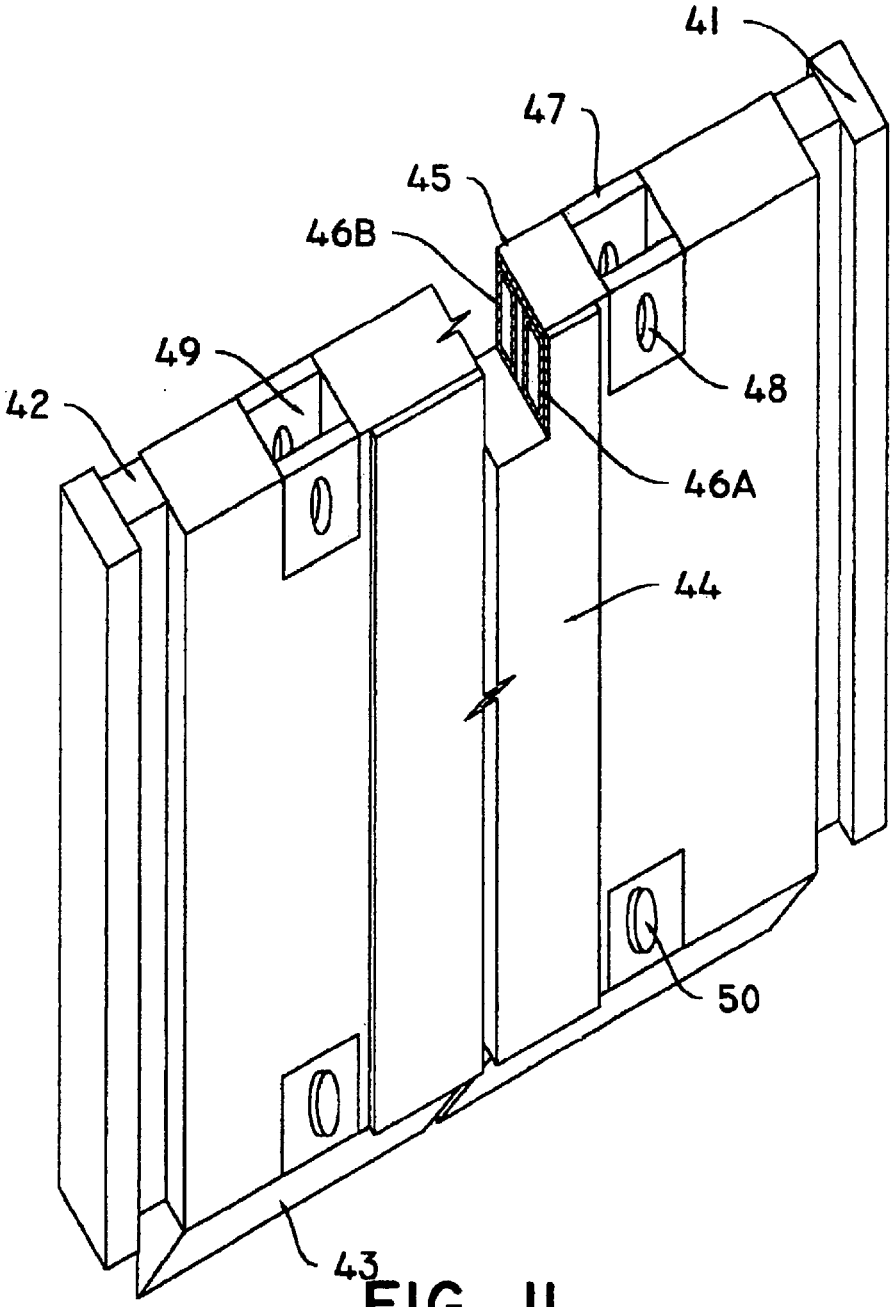
FIG. 11 shows a three dimensional view of a shoring panel depicting its main features.

As shown in FIG. 11, the shoring panel has guides 41 and 42 that slide inside the rail post, lifting plates 47 provided with a hole 48, and a cutting edge 43 fixed at bottom by the pin or bolt 50. To prevent damage to the panel, the upper part of it is composed by two square tubes 46A and 46 B slightly separated from each other and having a cover plate 45. The bottom and the top of the panel are identical and the panel may be used in either position. A thin flat plate 44, a skin, has be used between lifting plates 47, in the middle part of the panel only, to reinforce and reduce the bending of the panel due to the physical? moment that increases parabolically from zero at its ends to a maximum at the middle. Additionally, such a skin protects the panel exactly in the area where the bucket of the excavator is the most active.

Figure 12:
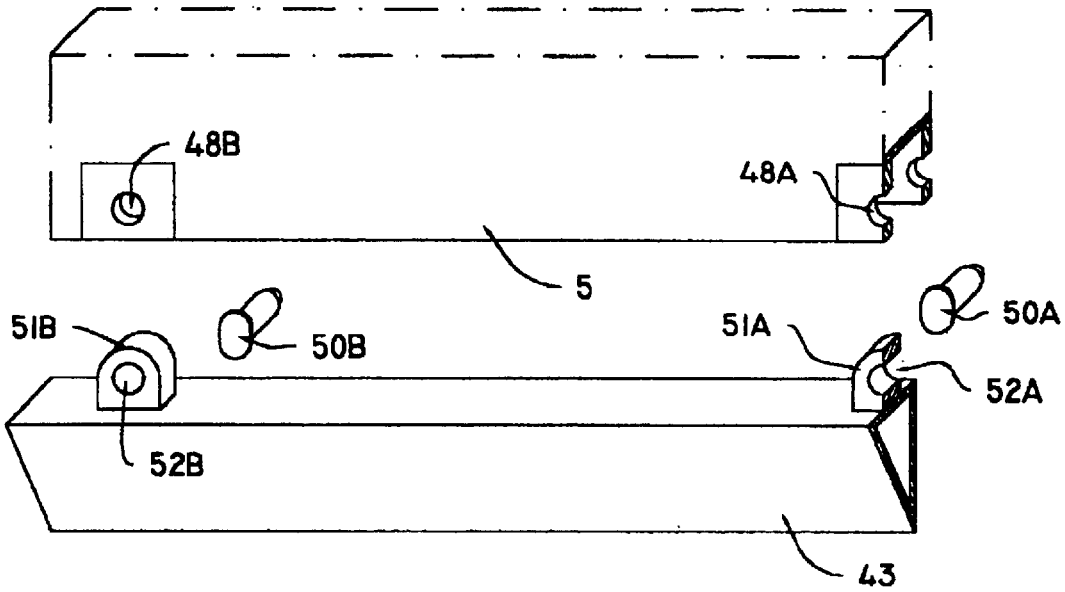
FIG. 12 is a partial three-dimensional view showing the connection of the cutting edge at the bottom of the panel.

The cutting edge 43 shown in FIG. 12, is pinned or bolted to the panel through holes 48A and 48B by the pins 50A and 50B via the plates 51A and 51B provided with holes respectively 52A and 52B.

Figure 13:
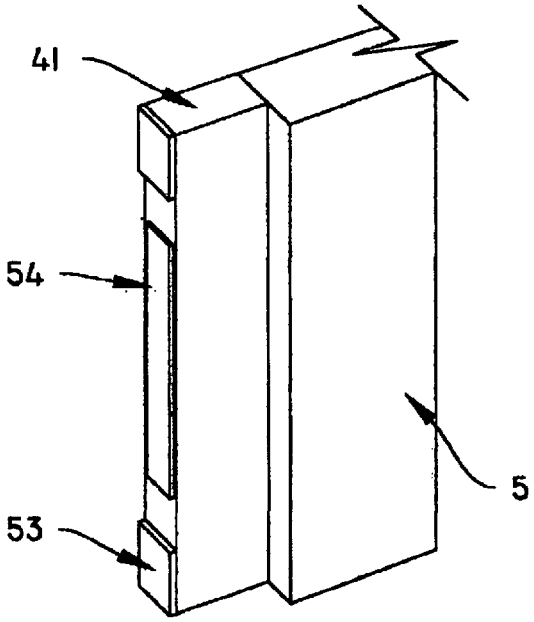
FIG. 13 is a three-dimensional view of the lateral end of a panel incorporating magnetic flat bars.

FIG. 13 illustrates another shoring panel 5 having a magnetic connection with linear and/or corner rail post by incorporating magnetic flat bars 54 on the sides of the panel guide 41. To prevent the damages on the magnetic flat bars, two plates 53 are fixed on the guide 41 to support the pressure of contact between post and panel.

Figure 14:
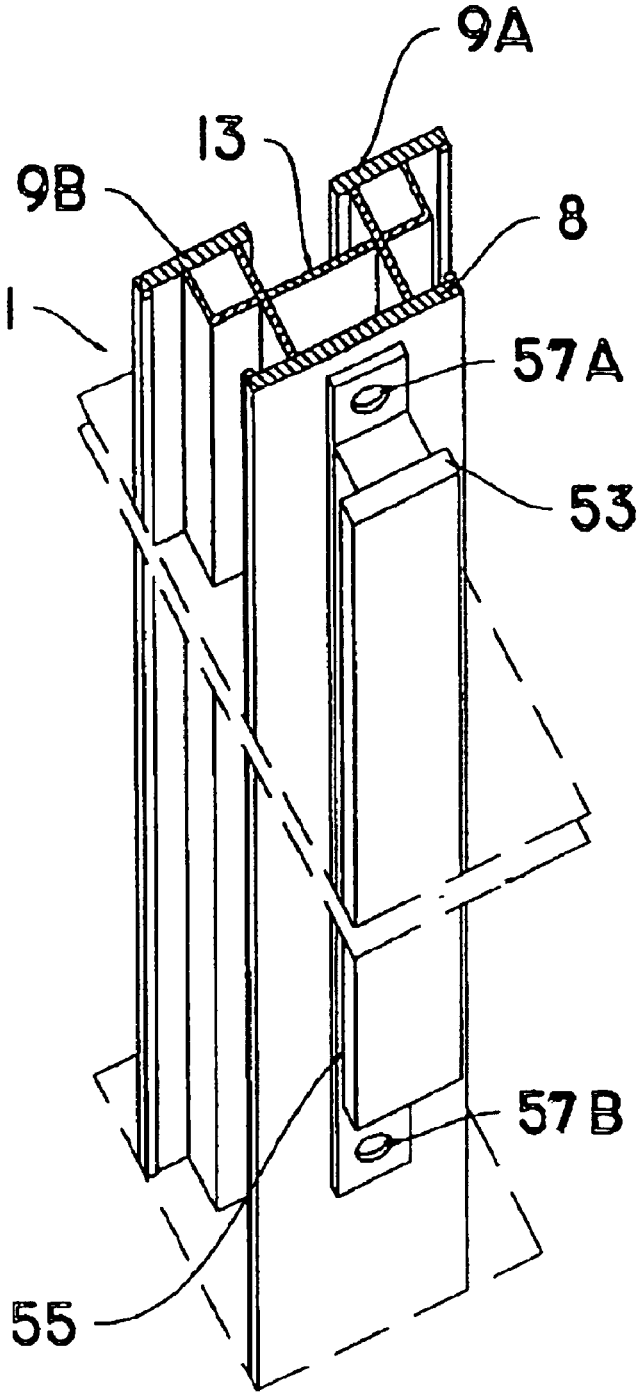
FIG. 14 shows a three-dimensional view of a sliding device fixed on the back of the rail post to slide formlockingly relative to another post.
Figure 15:
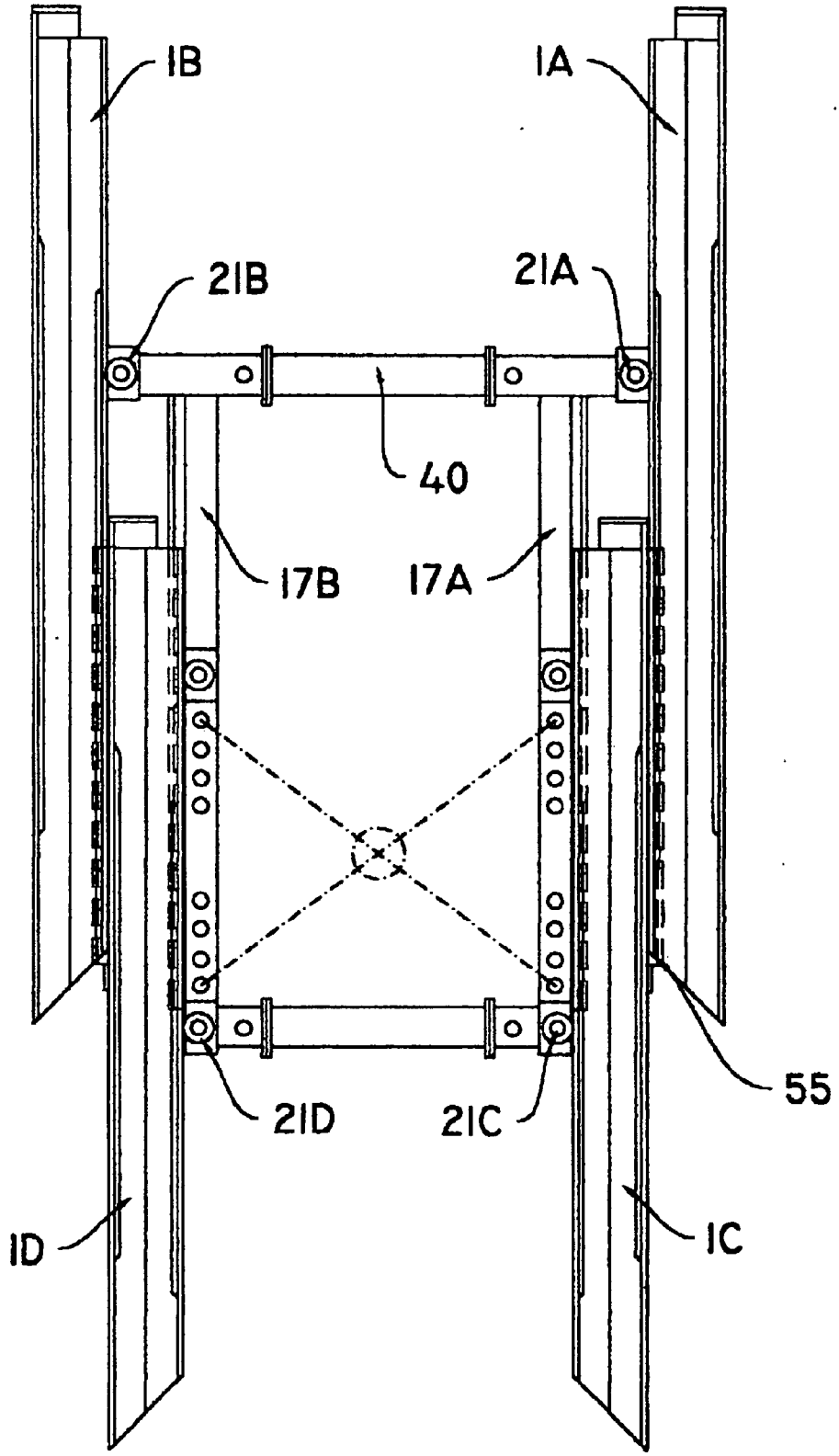
FIG. 15 shows a frame acting simultaneously on the upper and lower pairs of the rail posts.
Figure 16:
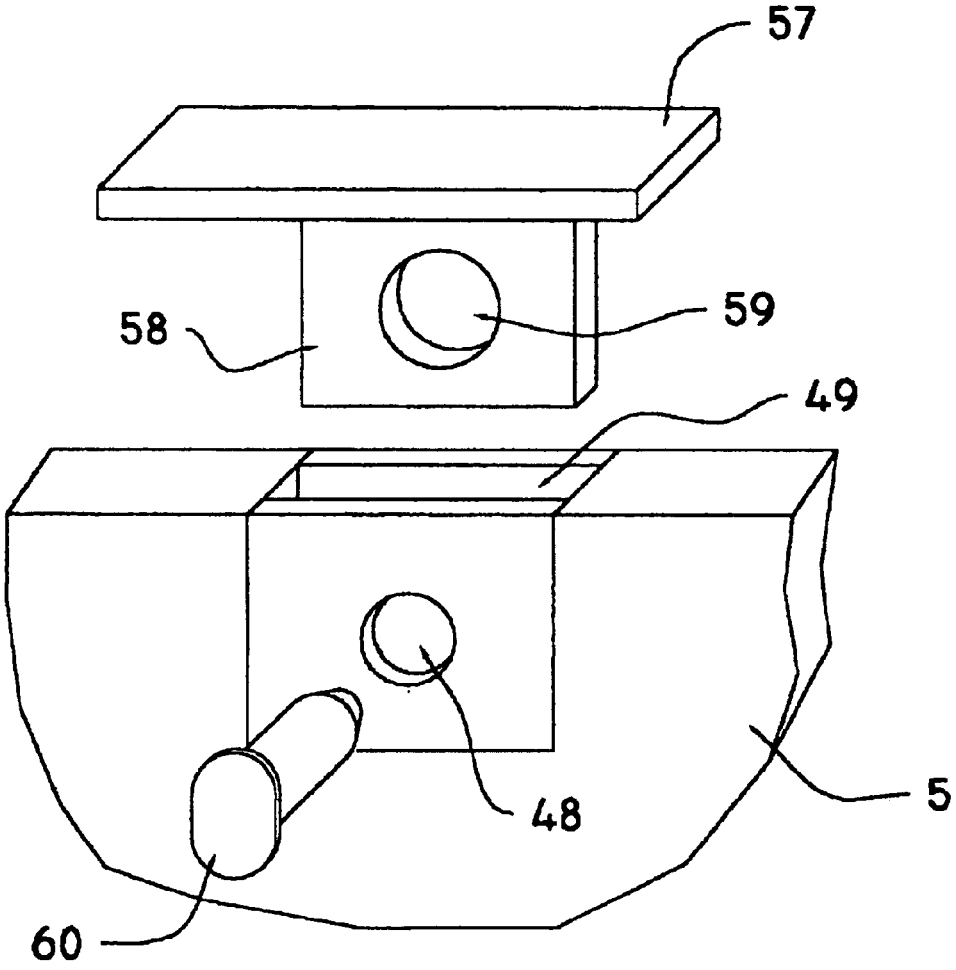
FIG. 16 is a three dimensional view of a hammering device to be affixed to the top of a panel for preventing its damage during installation in the ground.

As shown in the FIG. 14, a sliding device 55 may be fixed by bolts 57A and 57B on the back side of a rail post 1. This is desirable when the depth of excavation is great and there is a need to slide a pair of rail posts together. The sliding device 55 has a formlocking T shaped piece 53 that goes inside the 'C' channel in front of the other rail post identical to the 'T' shaped piece 20 of the articulated frame in the FIG. 1. As shown in the FIG. 15, the truss supporting the twin pairs of rail posts acts simultaneously on the upper pair of rail posts, 1A and 1B, through the rollers 21A, 21B and on the lower pair of rail posts, 1C and 1D, via the rollers 21C, 21D. The truss could be of articulated type as indicated schematically by the dash-dot line or as a rectangular frame. FIG. 16 shows another accessory device to be fixed on the top of the panel 5 to prevent damages during the installation of the system. The accessory device is made by welding together the two plates 57 and 58 and can be pinned or bolted by the pin 60 passing through the hole 48 (passing through plate 49)and 59.

I claim:

1. A shoring device comprising:

a) linear rail posts spacable apart along a trench in pairs and symmetrically on either side of a trench; each linear rail post having opposing sides and each said opposing side having a channel for slidably accepting shoring panels, the channels having a stepped cross section formed with two or more steps, each step defining a vertical guide completely or partially open, b) corner rail posts arrangeable vertically in a corner of a trench, each corner rail post having two sides that are substantially perpendicular to each other, each said side having a vertical channel for slidably accepting shoring panels, the channels having a stepped cross section formed with two or more steps, each step defining a vertical guide completely or partially open, c) shoring panels that are i) configurable to fit between linear rail posts adjacently located on either side of a trench having sides by slidingly engaging the adjacent linear rail post channels to form on either side of the trench a multi-step shoring wall of two or more steps, ii) configurable to fit between corner rail posts that are adjacently located by slidingly engaging the adjacent corner rail post channels to form a multi-step shoring wall of two or more steps, and iii) configurable to fit between corner rail posts and linear rail posts that are adjacently located by slidingly engaging the adjacent corner rail post channels and linear rail post channels to form a multi-step shoring wall of two or more steps, and d) at least two trusses slidably positionable along and formlockingly positionable between linear rail posts when those rail posts are symetrically located across a trench from each other; each said truss comprising i) a pair of vertical truss members slidable along a linear rail post and ii) a pair of cross members rotatably secured to each other and each cross member having ends configured to be pinnable to a vertical truss member, and wherein connection between the linear rail posts or corner rail posts and panels is magnetic and either the linear rail posts or the shoring panels further comprise magnets situated to effect such a connection.

2. The device of claim 1 where at least one of the vertical step guides in each linear rail post channel and in each corner step channel is configured to provide partial locking for the shoring panels.

3. The device of claim 1 wherein each of the step vertical guides has a length and that length is between ½ and ⅞ of the total length of the linear rail post.

4. The device of claim 1 wherein the linear rail posts further comprise a vertical guide member attached to an outer side of the linear rail post and adapted to accept an additional linear rail post.

5. The device of claim 1 wherein the vertical truss members further comprise lateral guide channels configured to allow vertical passage of shoring panels past the vertical truss member.

6. The device of claim 1 wherein the truss further comprises at least one spreader having spreader ends, the spreader ends configured to connect to a vertical truss member.

7. The device of claim 1 wherein the vertical truss members further comprise rollers configured to contact and to roll along a linear rail post.

8. The device of claim 1 wherein the shoring panels comprise magnetic flat bar members located to magnetically engage a linear rail post or a corner rail post.

9. The device of claim 1 wherein the linear rail posts and corner rail posts comprise magnetic flat bar members located to magnetically engage a shoring panel.

10. The device of claim 1 wherein the shoring panels further comprise a detachable cutting edge affixed by bolts or pins.

11. The device of claim 1 wherein the shoring panels further comprise a hammering surface.

* * * * *